United States Patent [19]

Harris, Jr.

[11] Patent Number: 4,960,279

[45] Date of Patent: Oct. 2, 1990

[54] GOLF PUTTER

[75] Inventor: Albert F. Harris, Jr., Leawood, Kans.

[73] Assignee: Intec Laboratories, Kansas City, Mo.

[21] Appl. No.: 484,242

[22] Filed: Feb. 26, 1990

[51] Int. Cl.[5] ..... A63B 53/04; A63B 69/36

[52] U.S. Cl. ..... 273/164; 273/167 J; 273/162 R; 273/32 H; 273/167 A; 273/183 D; 273/163 A

[58] Field of Search ..... 273/162 R, 162 B, 162 F, 273/163 R, 163 A, 164, 167 A, 167 E, 167 F, 167 J, 169, 170, 171, 173, 174, 183 D, 183 E, 32 H

[56] References Cited

U.S. PATENT DOCUMENTS

| | | | |
|---|---|---|---|
| 2,503,506 | 4/1950 | Miller | 273/183 A |
| 2,820,688 | 1/1958 | Morrison | 273/183 A |
| 3,595,582 | 7/1971 | Chapman | 273/194 A |
| 3,779,398 | 12/1973 | Hunter | 273/183 D |
| 3,824,698 | 7/1974 | Brucker | 273/162 R |
| 3,841,640 | 10/1974 | Gaulocher | 273/164 |
| 3,876,211 | 4/1975 | Caligiuri | 273/183 D |
| 3,880,430 | 4/1975 | McCabe | 273/183 D |
| 3,966,210 | 6/1976 | Rozmus | 273/167 F |
| 4,136,877 | 1/1979 | Antonious | 273/164 |
| 4,167,268 | 9/1979 | Lorang | 273/163 A |
| 4,209,172 | 6/1980 | Yamamoto | 273/183 C |
| 4,240,636 | 12/1980 | Swenson | 273/169 |
| 4,327,916 | 5/1982 | Shiratori | 273/163 A |
| 4,340,229 | 7/1982 | Stuff | 273/164 |
| 4,343,472 | 8/1982 | Hamilton | 273/164 |
| 4,369,974 | 1/1883 | Komperda | 273/164 |
| 4,390,184 | 6/1983 | Rudell | 273/183 D |
| 4,423,873 | 1/1984 | Shiratori | 273/163 A |
| 4,458,900 | 7/1984 | Antonious | 273/164 |
| 4,461,482 | 7/1984 | Bojicic | 273/183 D |
| 4,508,350 | 4/1985 | Duclos | 273/183 D |
| 4,519,612 | 5/1985 | Tsao | 273/163 R |
| 4,527,799 | 7/1985 | Solheim | 273/164 |
| 4,629,193 | 12/1986 | Pierman | 273/164 |
| 4,708,346 | 11/1987 | Pierce et al. | 273/164 |
| 4,712,798 | 12/1987 | Preato | 273/164 |
| 4,741,535 | 5/1988 | Leonhardt | 273/164 |
| 4,756,535 | 7/1988 | Bradley | 273/183 D |

*Primary Examiner*—George J. Marlo

*Attorney, Agent, or Firm*—Hovey, Williams, Timmons & Collins

[57] ABSTRACT

A golf putter includes a putter head formed of a novel composition including a portion of polytetrafluoroethylene resin on the face of the putter head to minimize friction between the putter and the golf ball. The entire putter head may be formed of an alloy including a portion of polytetrafluoroethylene resin. The putter includes a shaft which is connected to the putter head whereby a line extending along the surface of the shaft corresponding to the face hangs vertically when the putter is suspended by the grip in the manner of a pendulum. Additionally, the putter head is provided with at least one alignment line along the top surface of the putter head, the alignment line being perpendicular to the face of the head. The shaft is connected to the head at a region of intersection lying in the alignemnt line, the portion of the shaft adjacent the region of intersection being coated with material of a color corresponding to the color of the alignment line.

12 Claims, 1 Drawing Sheet

1 of 1

GOLF PUTTER

BACKGROUND OF THE INVENTION

1. Field of the Invention

This invention concerns a golf putter, and specifically a golf putter head, which is constructed to minimize friction between the face of a putter head and the golf ball and to aid the golfer in aligning the putter toward the hole. The putter head is constructed of a novel material which enables the putter to be properly balanced and sufficiently durable while also minimizing the effect of spin caused by frictional contact between the putting face and the ball.

2. Description of the Prior Art

Putting a golf ball is a precision evolution resulting in the development of various designs having a common goal of making it easier for a golfer to "sink" a putt. In order to make the game fair and prevent undue advantages based solely on technology, various ruling organizations such as the United States Golf Association (USGA) have established parameters which limit the configuration of the club.

Nevertheless, within these parameters, a startling variety of different putters have been developed. In many cases, the changes or developments have been addressed to the balance or alignment of the putter. In other circumstances, the developments have addressed the way in which the shaft connects to the club head. Finally, some developments have addressed the putter's face—that is, that portion of the putter which strikes the ball.

With respect to the developments which have concerned the putter's face, one of the principal goals has been to allow the golfer to exercise greater control over the ball during his or her stroke. It has been widely believed that the golfer may make a more accurate putt if the contact between the putter and the ball can be prolonged, thereby using the putter to influence the ball's roll. Therefore, clubs have been designed which yield an increased coefficient of friction between the putter face and the ball. The number of different clubs which have been developed under this philosophy has resulted in the adoption by the USGA of a rule limiting the configuration of the club face. Rule 4-1e.*Club Face* of the 1985 edition of Rules of Golf by the USGA states that the club face must not be designed like a spring so as to "unduly influence the movement of the ball", and that the "surface roughness must not exceed that of decorative sandblasting." Numerous other references are found throughout the rule which attempt to prevent the use of a club with a face which unduly influences the movement of the ball. It may thus be appreciated that the efforts of club manufacturers have been devoted to increasing surface roughness or design to prolong engagement with the ball and impart movement to it, limited by the USGA rule.

SUMMARY OF THE INVENTION

However, I have discovered that a golfer's putting accuracy may be improved, and therefore his or her putting proficiency increased, by a putter which has a minimum coefficient of friction during engagement with the ball.

It may be understood that the greater the coefficient of friction therebetween, the greater the influence imparted by the putter to the rotation of the ball. If the putter strikes the ball with the face exactly perpendicular to the line between the ball and the hole, the stroke of the putter is along that line immediately prior to and during striking of the ball, and the putter head contacts the ball at the exact center of gravity, no spin will be imparted to the ball around a vertical axis.

Such a perfect stroke seldom, if ever, occurs, and inevitably the frictional engagement between the putter and the ball results in spin being imparted to the ball during contact with the putter face. This spin causes the ball to depart from its desired line of travel and may result in a missed put.

In the putter of the present invention, the conventional wisdom (that greater friction between the putter face and the ball aids putting) is dismissed and a putter is presented which has a face designed to minimize such friction. The face is provided with a novel alloy containing a portion of TEFLON, a synthetic fluorine-containing resin manufactured by duPont. The remaining constituents of the alloy may include bronze and stainless steel to provide sufficient weight, hardness and friction resistant qualities so that the putter head may be durable in use. Moreover, the putter of the present invention may be constructed with the entire putter head of the same alloy whereby the putter may more easily glide across the surface of the putting green during the stroke, thus further minimizing deflection and alignment problems arising from "scuffing" during the putting stroke.

In addition, preferred embodiments of the putter head of the present invention are advantageously configured to aid the golfer in alignment of the club. The putter head is preferably of a generally green color in order to allow it to visually blend with the grass on the putting green. The golfer's eyes are directed to a pair of intersecting, perpendicular lines along the top of the club head which are preferably of a contrasting color such as white to enable him or her to focus on the proper alignment of the club prior to the putting stroke.

In especially preferred embodiments, the shaft of the putter is joined to the putter head at an angle at the longitudinal center of balance of the putter head. To further minimize distraction to the golfer, the portion of the shaft immediately adjacent the putter head is provided with a region colored complimentarily to the alignment lines. The colored portion of the shaft extends vertically from the alignment lines so that the golfer, when viewing the putting head from above, may focus on the alignment lines and the ball without distraction caused by a contrasting color on the shaft.

DESCRIPTION OF THE PREFERRED EMBODIMENT

Figure 1:
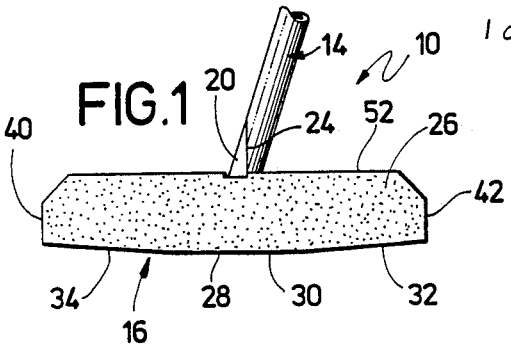
FIG. 1 is a fragmentary front elevational view of a putter in accordance with the present invention showing a portion of the shaft and the head of the putter.
Figure 2:
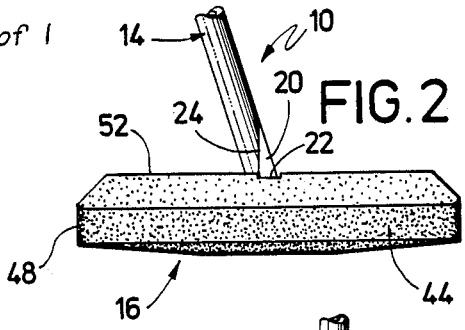
FIG. 2 is a fragmentary rear elevational view similar to FIG. 1.

Referring now to the drawing, an improved golf putter 10 is provided which broadly includes a grip 12, shaft 14, and putter head 16. The grip 12 may be provided with a flat surface for ease in grasping by the golfer 18. The shaft is preferably substantially rigid and made of any of a number of lightweight materials which resist corrosion such as aluminum, stainless steel, chrome-plated tempered steel or alternatively synthetic materials yielding similar qualities. The putter head 16 is joined to the shaft 14 to present a unitary structure.

In greater detail, the putter head 16 is joined to the shaft by a suitable adhesive and shaft 14 includes a colored region 20 which may be covered by any colored material such as a decal or paint. Shaft 14 is of a color such as metallic silver, which is different than that of an alignment line 22. The region 20 is colored corresponding to the alignment line 22 which is oriented along the midline of the putter head 16. The region 20 is defined by a vertical border 24 whereby a golfer standing over the club and aligning his putt will not be distracted by the portion of the shaft which visually intersects with the alignment line 22.

The putter head 16 is uniquely provided with a smooth, flat, golf ball engaging face 26 which includes a quantity of friction-resistant synthetic resin material such as polytetrafluoroethylene resin, commonly manufactured and sold under the trademark TEFLON by E. I. duPont. The face 26 is preferably smooth and uninterrupted, as well as being vertical in use when the putter 10 is at rest on the ground with the head 16 resting on the grass of the putting surface and during contact with the ball during a normal putting stroke. The face 26 is thus unlofted.

The face 26 of head 16 preferably is composed of an alloy material including thirty percent or more virgin TEFLON. The entire head 16 may be manufactured of the same alloy. The alloy material should include 30 to 60 percent TEFLON, 35 to 60 percent bronze, and 1 to 10 percent stainless steel. In particularly preferred forms, the head 16 is formed of an alloy comprising 53 percent virgin TEFLON, 40 percent bronze of at least about 200 mesh size, 5 percent stainless steel of at least about 200 mesh size, and 2 percent chromium oxide to serve as a green pigment. The bronze used in the alloy is preferably approximately 88.5 percent copper, approximately 9 percent tin, and includes zero to 2.5 percent zinc. The resulting alloy is green in color, has a Shore Hardness of at least 65D, a specific gravity in excess of 2.3 and preferably of 3.4 gms/ml, a static coefficient of friction of less than 0.09 and preferably of 0.07 and a dynamic coefficient of friction of less than 0.16 and preferably of 0.13.

The head 16 of the putter 10 of the present invention may thus be formed of a unitary block of the alloy as set forth above. The head 16 is formed under pressure as in a hydraulic press and may also be extruded, and then machined into the desired configuration. The bottom surface 28 of the head 16 includes a flat, horizontal component 30 with upwardly angled side portions 32 and 34 to make sloped putting easier, and an upwardly angled back portion 36 to minimize heel drag during the stroke. A rounded radius 38 is presented at the intersection between the face 26 and the bottom surface 28 to reduce drag when the putter 10 "scuffs" the turf 62 during the putting stroke.

The putter head 16 is configured to present a distal end 40, a proximal end 42, and a back edge 44, as well as face 26, bottom surface 28 and a top surface 46. The putter head 16 has its maximum circumference at its midsection 48 extending around face 26, distal end 40, back edge 44 and proximal end 42 which serves to concentrate the mass of the putter at the elevation most proximate to the point of contact with the golf ball 50. The top surface 46 of the head 16 includes a substantially horizontal upper portion 52, which receives thereon alignment line 22 and stance line 54. The substantially horizontal portion 52 is perpendicular to face 26 as an aid to accurate alignment of the putter head.

Alignment line 22 is formed or machined in the horizontal upper portion 52 of head 16, and is preferably painted or otherwise colored in contrast to the remainder of head 16. For example, when head 16 is formed of the preferred alloy it is green in color to aid the golfer 18 by reducing distractions in the configuration of the putter head 16, alignment line 22 is then painted or otherwise colored white, as is the perpendicular stance line 54 which is also formed or machined in the upper portion 52 of head 16.

In use, the putter 10 hereof presents a number of advantageous features for the golfer 18. The golfer 18 often finds it necessary to estimate whether or not his or her putt will break by using the putter as a plumb bob. Many putter shafts are tapered, preventing the golfer from having a true vertical reference for the purpose of determining the slope of the putting green. In the present putter 10, the shaft 14 is mounted to the head 16 so that the edge 56 of the shaft 14 corresponding to the face 26 will be vertical when the putter 10 is suspended like a pendulum from its grip 12.

Figure 3:
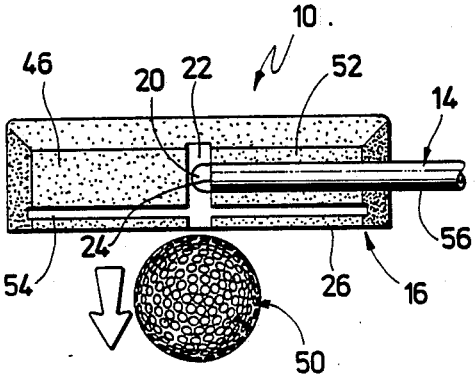
FIG. 3 is a fragmentary top plan view of a putter in accordance with the present invention showing the head of the putter adjacent a golf ball and an arrow illustrating the direction of the putting stroke.
Figure 4:
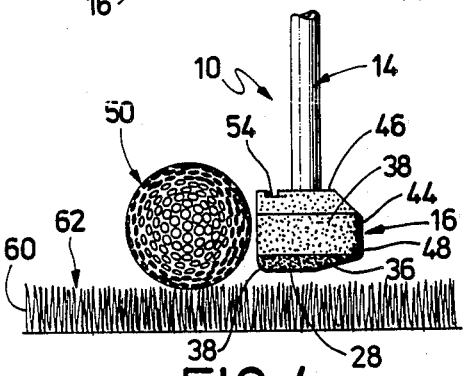
FIG. 4 is a right side elevational view showing the putter head of a putter in accordance with the present invention in position for striking a golf ball.
Figure 5:
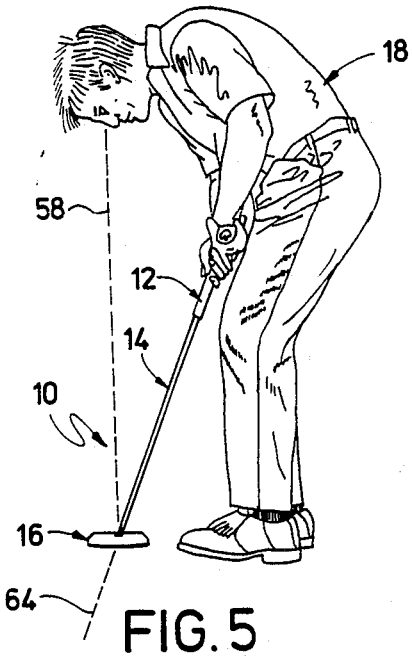
FIG. 5 is a view of a golfer in his putting stance over a putter in accordance with the present invention.

As seen in FIG. 5, the golfer 18 then lines up over the ball 50 for the putting stroke. In the preferred putting stance, the golfer 18 is positioned so that his line of sight 58 is substantially vertical with respect to the ball 50. In this putting stance, the golfer is presented with an overhead view substantially as in FIG. 3, the ball resting on the grass 60 of the turf 62 as shown in FIG. 4.

When using, e.g., a white golf ball 50, the golfer must focus and concentrate on the ball in making his or her putt. The putter 10 hereof minimizes distractions to the golfer 18, as the alignment line 22 and the stance line 54 are colored complimentarily to the ball 50, while the remainder of the putter head 16 is colored green to blend in with the grass 60. Because the alloy itself is preferably minimally reflective and green in color, chipping or wear of the surface of the head 16 does not affect this feature. Preferably, the putter head 16 is of a simple configuration to avoid distraction, so that the golfer 18 may concentrate on the putt.

The face 26 of the putter 10 includes a portion of TEFLON, and preferably is of an alloy containing TEFLON, bronze, stainless steel and chromium oxide in the proportions set forth hereinabove. The face of the putter thus has a minimal coefficient of friction with the golf ball 50 at the point of contact. The point of contact is best seen in FIGS. 3 and 4 and is located immediately forward of alignment line 22 and in the region of the face 26 corresponding to the midsection 48. The face 26, having a minimal coefficient of friction with the ball 50, releases the ball 50 on contact allowing it to roll along the turf 62 without spin imparted by the head 16. The alloy hereof is sufficiently hard to prevent the ball 50 from indenting the face 26 to any sufficient degree to cause any effect on the ball, while being sufficiently dense so as to minimize twisting of the putter 10 if the golfer 18 mishits the ball and strikes it off-center. The face 26 is unlofted so that when the ball 50 lies on a sloping turf 62, the face 26 will remain true to an intended putting line 64. Therefore, when ball 50 is struck by face 26, ball 50 will leave face 26 in a direction perpendicular to stance line 54, along alignment line 22 and on the intended putting line 64, thereby eliminating ball push and pull causes by face loft.

The composition and configuration of the putter head 16 hereof are designed to cause the putter to impart force to the ball along the path of the swing of the golfer, minimize distractions to the golfer's concentration, and allow the ball to simply roll toward the cup without undesirable spin or other influences affecting the path of the ball 50.

I claim:

1. A golf putter head comprising:

a top surface;

a bottom surface; and a forward-facing putting face for striking a golf ball, said face being formed of a mixture of materials including a substantial portion of one material which is a friction-resistant synthetic resin whereby the striking face of the putter has a minimal coefficient of friction with the golf ball at the point of contact.

2. A golf putter head as set forth in claim 1, wherein said friction-resistant synthetic resin is polytetrafluoroethylene resin.

3. A golf putter head as set forth in claim 2, wherein said face is substantially smooth and flat.

4. A golf putter head as set forth in claim 3, wherein said material is an alloy including a quantity of bronze.

5. A golf putter head as set forth in claim 3, wherein said material is an alloy including a quantity of stainless steel.

6. A golf putter head as set forth in claim 3, wherein said material is an alloy including about 30 to 60 percent polytetrafluoroethylene resin, 35 to 60 percent bronze, and 5 to 10 percent stainless steel.

7. A golf putter head as set forth in claim 6, wherein said head is formed substantially entirely of said alloy.

8. A golf putter head as set forth in claim 1, wherein said face has a static coefficient of friction of less than 0.09.

9. A golf putter head as set forth in claim 1, wherein said face has a dynamic coefficient of friction of less than 0.16.

10. A golf putter head as set forth in claim 1, wherein said putter head includes a top surface presenting an alignment line of a color contrasting to said head.

11. A golf putter head as set forth in claim 10, wherein said putter head presents a top surface which is substantially green in color and said alignment line is of a contrasting color.

12. A golf putter comprising:

a shaft;

a putter head of a first color connected to said shaft presenting a ball engaging face and a top surface;

said top surface including an alignment line substantially perpendicular to said face, said alignment line being of a second color contrasting to said first color; and coloring coating means of said second color applied to said shaft proximate an intersection between said shaft and said putter head, said intersection coinciding with a portion of said alignment line, said coloring coating means being applied to the portion of said shaft lying in the same vertical plane as said alignment line when said putting face is substantially vertical and said top surface is substantially horizontal.

* * * * *